United States Patent [19]

Robinson

[11] 4,157,762

[45] Jun. 12, 1979

[54] OPEN-MOUTH CONTAINERS

[75] Inventor: James D. Robinson, Welwyn Garden City, England

[73] Assignee: Imperial Chemical Industries Limited, London, England

[21] Appl. No.: 856,984

[22] Filed: Dec. 2, 1977

[30] Foreign Application Priority Data

Aug. 8, 1977 [GB] United Kingdom ..... 33157/77

[51] Int. Cl.[2] ..... B65D 1/00

[52] U.S. Cl. ..... 220/1 R; 220/306; 220/DIG. 13; D9/167; D9/168; D9/267

[58] Field of Search ..... D9/167, 168, 267; 220/1 R, 306, DIG. 13

[56] References Cited

U.S. PATENT DOCUMENTS

| | | | |
|---|---|---|---|
| D. 40,081 | 6/1909 | Mawer | D9/167 |
| D. 93,116 | 8/1934 | Leach | D9/167 |
| 3,173,574 | 3/1965 | Goldsmith | 220/306 X |
| 3,441,172 | 4/1969 | Dike | D9/167 X |
| 3,556,338 | 1/1971 | Wilkinson | 220/306 |
| 3,563,408 | 2/1971 | Bloemendaal | 220/1 R X |
| 3,655,153 | 4/1972 | Terrell | 220/306 X |
| 3,871,544 | 3/1975 | Peyser | 220/306 X |
| 4,046,282 | 9/1977 | Ruch | 220/306 X |

*Primary Examiner*—Joseph Man-Fu Moy

*Attorney, Agent, or Firm*—Cushman, Darby & Cushman

[57] ABSTRACT

An open-mouth container having a mouth which partially undercuts the body of the container yet which can be shaped about a simple core.

8 Claims, 20 Drawing Figures

OPEN-MOUTH CONTAINERS

This invention relates to an open-mouth container (such as a paint can) suitable for lidding and adapted to be easily shaped using moulds comprising core and preferably also cavity components.

When an open-mouth container is to be lidded, it is often designed so that the perimeter of the lid when applied to the mouth will not overhang the body of the container. Overhanging lids space apart the containers wasting storage space and when containers with such lids form a line of lidded containers which issues from a lidding machine, it is found that the line lacks stability if the bodies of adjacent containers are not contiguous. Over-hanging lids can be avoided by providing the container with a mouth whose perimeter is defined by an inwards extension of the body so that the perimeter of the body protrudes beyond the perimeter of the mouth. However this means that the perimeter of the mouth undercuts the body. Therefore if the container is to be shaped using a mould having a core component, then the undercutting perimeter can only be obtained using complex techniques involving five or more movements of segments of the core and such techniques are generally prone to excessive wear and also cannot be cooled quickly enough to be used economically in the mass production processes used in shaping articls such as disposable containers.

The object of this invention is to provide a container which can be placed next to a similar container with the bodies of the containers contiguous even when they are lidded and which can be shaped around the core component of a mould (especially the core component of a core-and-cavity mould) using a relatively simple technique.

Accordingly the invention provides an open-mouth container comprising a body part composed of at least four longitudinal portions, extensions of which define the perimeter of the mouth, wherein at least two of the portions are protruding portions whose internal transverse perimeters lie outside the perimeter of the mouth and therefore their mouth-defining extensions extend inwards to the mouth and at least two of the portions are inset portions whose internal transverse perimeters do not lie outside the perimeter of the mouth and therefore their mouth-defining extensions do not extend inwards to the mouth, the protruding portions being separated from one another by inset portions, and wherein the dimensions of the internal transverse perimeters of the portions are such that if the inset portions were notionally removed from the body part and the protruding portions were notionally moved inwards until they touch along their longitudinal boundaries, then the notional surface defined by the internal transverse perimeters of the touching protruding portions would be capable of being passed through the mouth of the container. Preferably the transverse perimeter of such notional surface should be smaller than the perimeter of the mouth, although some latitude in this respect can be tolerated if the perimeter of the mouth is resiliently deformable. "Longitudinal" means lengthwise of the container and the length of the container is the length of its principal axis, namely the axis which passes through its base and mouth. "Transverse" means in a plane perpendicular to the principal axis.

The invention also provides a process for making the containers which comprises (a) shaping material around the core component of a mould which defines inner surfaces of the container wherein the core comprises at least two first segments which define the inner surface of the protruding portions of the body part of the container and which are separated from one another by at least one second segment which defines at least part of the inner surfaces of the inset portions of the body part of the container, (b) withdrawing the second segment or segments through the mouth of the newly shaped container, (c) moving the first segments into space vacated by the second segment or segments, (d) withdrawing the first segments through the mouth, and (e) if necessary employing means (preferably a cavity component of the mould) to shape the outside surface of the container.

The invention further provides a core component for the mould, the core component comprising at least two (preferably two or three) first segments separated from one another by at least one (and preferably only one) second segment, and also a mould comprising a combination of such a core and a cavity component which defines the outer surface of the container. Preferably the segments of the core are tapered to facilitate withdrawal of the second segment or segments.

A container according to this invention even when suitably lidded can still be placed next to a similar lidded container so that the body parts of the containers are contiguous. This is possible because the protruding portions of the body part lie outside the perimeter of the mouth so that a lid of suitable dimensions applied to the mouth will not overhang at least part of the protruding portions.

The containers can be shaped around a core component of a mould using a relatively simple core which can be withdrawn through the mouth of the newly shaped container by an operation which needs only three movements of segments of the core although extra movements can be added if desired. This is possible because the internal surfaces of the inset portions of the body part of the container are not undercut by the perimeter of the mouth. Therefore the second segment or each second segment of the core (which defines at least part of these internal surfaces) can be directly withdrawn through the mouth and the first segments moved into space vacated by the second segment or segments whereafter the first segments too can be withdrawn through the mouth.

The protruding and inset portions of the body part of the container may be curved or flat. Preferably the protruding and inset portions are of approximately uniform thickness so that the internal transverse perimeter of a portion is of substantially the same shape as the transverse section of the portion.

Typical containers having protruding and inset portions of uniform thickness may comprise portions all of which are curved, the protruding portions being of greater curvature than the inset portions so producing a lobate container in which the protruding portions constitute the lobes. Preferably a bi-lobate container in transverse section has the shape of an oblate circle, that is to say a circle modified by the replacement of two diametrically opposed arcs by opposed curves whose maximum diameter is less than the diameter of the circle. These curves therefore consitute inset portions while the remaining arcs of the circle constitute lobes.

Preferably the maximum diameter of the inset portions is at least 90% (preferably at least 95%) of the diameter of the circle and the inset portions preferably subtend an angle of from 20° to 80° to the principal axis of the container so as to produce a container which appears to by cylindrical. Alternatively the containers may be elliptical in transverse section. Optionally the curvature of the inset portions may be decreased until the inset portions are flat or even concave. Bi- and tetra-lobate containers are preferred for use in lidding machines.

If desired the inset portions may take the form of narrow longitudinal re-entrant flutes, each flute preferably providing less than 10% of the internal transverse perimeter of the container. It is also preferred that the flutes be curved in transverse section since this facilitates the shaping process.

If the protruding portions of the body part of the container were parallel to the principal axis of the container, such an arrangement would provide a maximum line of contiguity between contiguous containers. However the core component of the mould is more easily withdrawn from the container if the protruding and inset portions of the body part are inclined so that the container tapers towards its base. Preferably the portions are inclined at an angle of from 0.1° to 3° (especially 0.2° to 0.6°) to the principal axis. Provided small inclinations are employed the taper does not seriously interfere with the ability of containers to pack together efficiently or to be stable in processing lines possibly because the resilience of the container accommodates the taper sufficiently to allow a useful length of contiguity between contiguous containers.

It is preferred that the transverse sectional area of the mouth be at least 85% of the maximum transverse sectional area of the body part of the container. Lids suitable for application to the mouths of the containers preferably have dependent skirts which engage about the perimeter of the mouth. Engagement may be simply by a push fit but preferably the skirt and perimeter are adapted to provide a positive engagement, for example by providing them with mating screw threads or profiles which engage with a snap action.

The containers may be shaped from any materials which can be made to comply with the shape of the core component of the mould. For example sheets of ductile metal may be swaged around the core or sheets of heat-softened thermoplastics may be vacuum-formed around the core. Preferably the containers are made by injecting fluid material into the core-and-cavity mould. The fluid material may be a curable synthetic resin but preferred fluid materials are molten thermoplastic polymers, especially thermoplastic polyolefins including polystyrene. Suitable aliphatic polyolefins include polyethylenes of low or high density, crystalline copolymers of ethylene with up to 20% by weight of methyl, ethyl or butyl acrylate or methacrylate or vinyl acetate, or crystalline polymers of propylene. Although propylene homopolymer may be used, adjacent containers are better able to accommodate tapered body parts if the polymer is one in which propylene is copolymerised with ethylene either as a random copolymer of propylene and a minor amount of ethylene or as a sequential copolymer of propylene with up to 15% by weight of ethylene made by injecting the ethylene into the latter stages of what would otherwise have been a homopolymerisation of propylene. The melt flow index of the polyolefin is preferably from 1.5 to 30 grams per 10 minutes when measured according to British Standard 2782:Part 1/105C/1970 using a 2.16 Kg load and performed at 190° C. in the case of the ethylene polymers and at 230° C. in the case of the propylene polymers.

The invention is further illustrated by the following preferred embodiments described with reference to the drawings of which:

Figure 1:
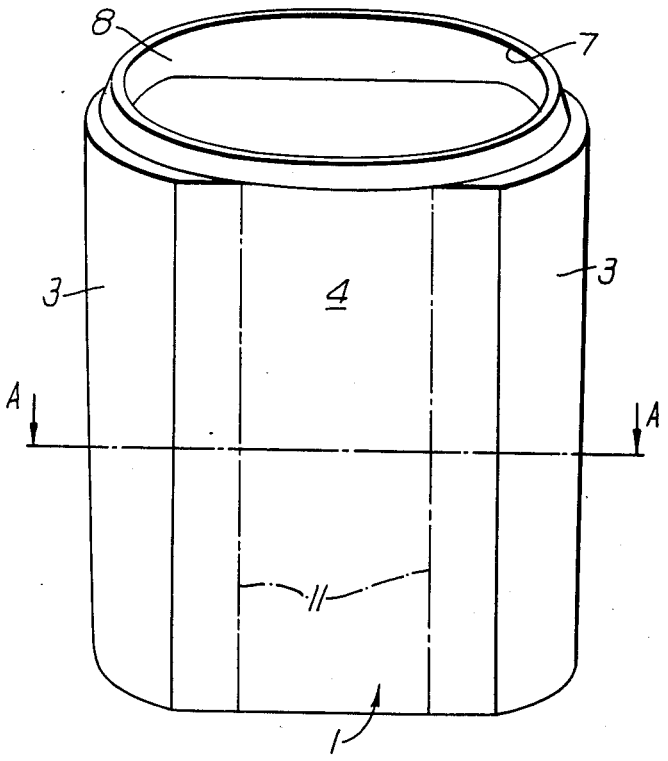
FIG. 1 shows in perspective a bi-lobate container having flat inset portions.
Figure 2:
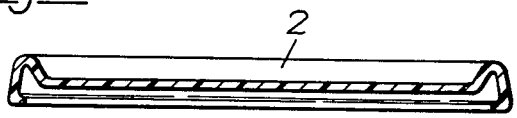
FIG. 2 shows in section a skirted lid suitable for use on the container shown in FIG. 1.
Figure 3:
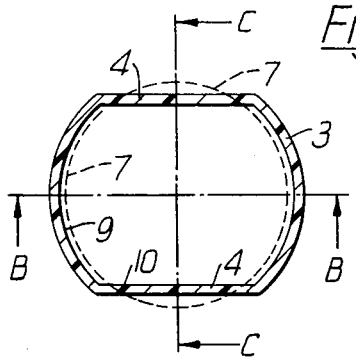
FIG. 3 shows on a smaller scale a transverse section of the container on the line AA of FIG. 1.
Figure 4:
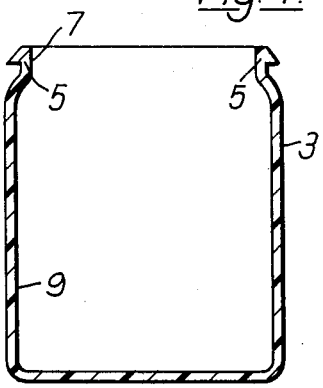
FIG. 4 shows a longitudinal section of the container on the line BB of FIG. 3 (which is the same as line AA in FIG. 1).
Figure 5:
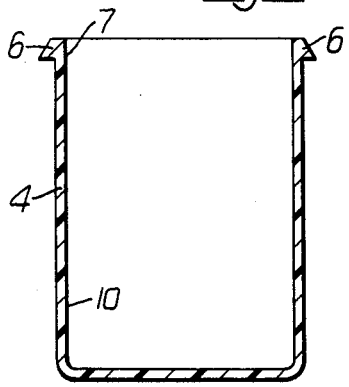
FIG. 5 shows a longitudinal section of the container on the line CC of FIG. 3.

FIG. 1 shows an open-mouth container 1 having a body part composed of two longitudinal protruding portions or lobes 3 and two flat inset portions 4. Lobes 3 and flat inset portions 4 have extensions 5 and 6 respectively which are shown in FIGS. 4 and 5. Extensions 5 and 6 together define perimeter 7 of the open mouth 8. The extensions 5 of lobes 3 extend inwardly so that lobes 3 and more particularly their internal transverse perimeters 9 lie outside and are therefore undercut by perimeter 7 of open mouth 8 as is shown in FIG. 3. This enables a suitably sized circular lid 2 as shown in FIG. 2 to be applied to perimeter 7 without overhanging lobes 3.

Figure 6:
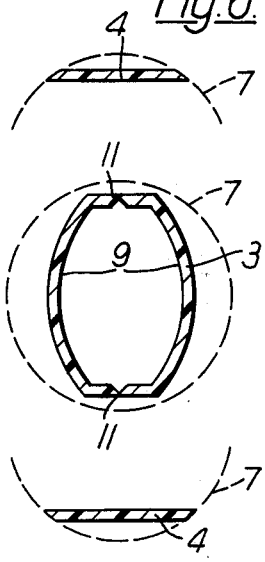
FIG. 6 shows diagrammatically a notional arrangement in which the inset portions of FIG. 3 are removed and the outset portions or lobes are moved notionally together.
Figure 7:
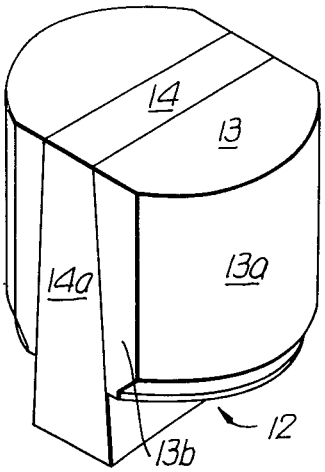
FIG. 7 shows on a larger scale a core suitable for use in shaping the container shown in FIG. 1.

In contrast extensions 6 are straight extensions of flat inset portions 4 not extending inwards. Accordingly as is shown in FIG. 3, inset portions 4 and more particularly their internal transverse perimeters 10 lie within perimeter 7 of open mouth 8. This means that if inset portions 4 are notionally removed from container 1 as shown in FIG. 6 and lobes 3 are notionally moved inwards until their longitudinal boundaries 11 (see FIG. 1) touch, then their internal transverse perimeters 9 would define a surface as shown in FIG. 6 which could notionally be passed through open mouth 8. The importance of this is that it enables container 1 to be shaped around a core 12 as shown in FIG. 7 despite the undercutting of lobes 3 by perimeter 7 for reasons which will now be explained.

Core 12 has first segments 13 separated by tapered second segment 14. During moulding in a mould comprising core 12 and cavity 15 a shown in FIGS. 8, 9 and 10 the internal surfaces 9 of lobes 3 and part 10*a* of the internal surface 10 of flat inset portion 4 are defined respectively by outer longitudinal surfaces 13*a* and 13*b* of first segments 13. At the same time, the remainder 10*b* of the internal surface 10 of flat inset portion 4 is defined by outer longitudinal surface 14*a* of second segment 14. Because extension 5 does not extend inwards of flat inset portion 4, perimeter 7 of open mouth 8 does not undercut flat inset portion 4 and therefore second segment 14 of core 12 can be withdrawn from newly moulded container 1 through its open mouth 8 whereupon it vacates space 16 shown bounded by dashed lines in FIG. 9. First components 13 are moved into space 16 (as shown bounded by dashed lines in FIG. 10) and then they too can be withdrawn through perimeter 7 of open mouth 8. Hence despite the undercutting of lobes 3 by perimeter 7, core 12 can be withdrawn from container 1 with a minimum of three movements of segments 13 and 14 relative to container 1.

Figure 8:
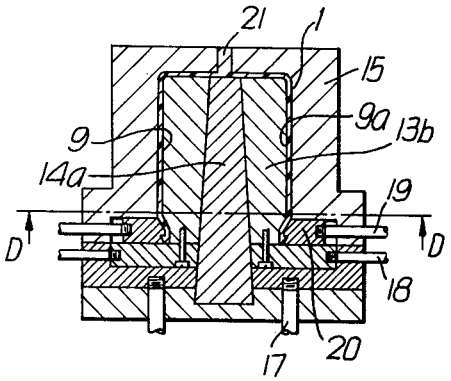
FIG. 8 shows on a smaller scale in section the core of FIG. 7 in position in a core-and-cavity mould.
Figure 9:
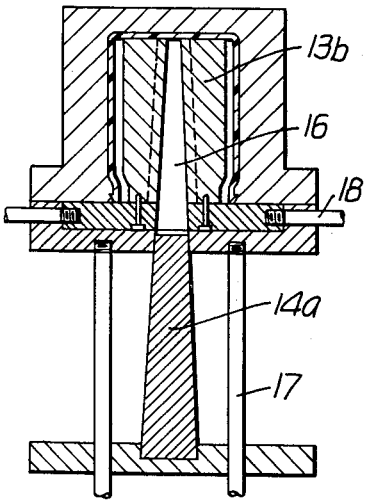
FIG. 9 shows in section the mould of FIG. 8 with the second segment of the core withdrawn and the first segments closed together.
Figure 10:
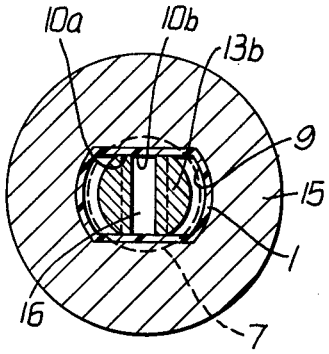
FIG. 10 shows a section on the line DD of FIG. 8 after the cores have been moved together as shown in FIG. 9.

The mould shown in FIGS. 8, 9 and 10 is provided with bars 17 which guide second segment 14 during its withdrawal. Push rods 18 are provided which are used to move first segments 13 into space 16 vacated by second segment 14 whereafter cavity 15 and container 1 can be lifted clear of first segments 13 during which movement first segments 13 are passed through open mouth 8. Rectractable bars 19 are provided to retract components 20 of cavity 15 so that container 1 can be knocked out of cavity 15 by a blow on sprue 21.

The lobes 3 and inset portions 4 of container 1 are tapered at an angle of 0.25° to the principal axis of container 1 to facilitate withdrawal of second segment 14 and the knocking of container 1 out of cavity 15. The taper is exaggerated for clarity in FIGS. 1, 4, 5, 8, 10, 11 and 12.

Figure 11:
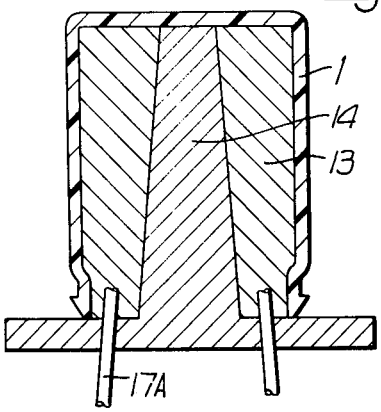
FIGS. 11 and 12 show a modification of the mould shown in FIGS. 8, 9 and 10.
Figure 12:
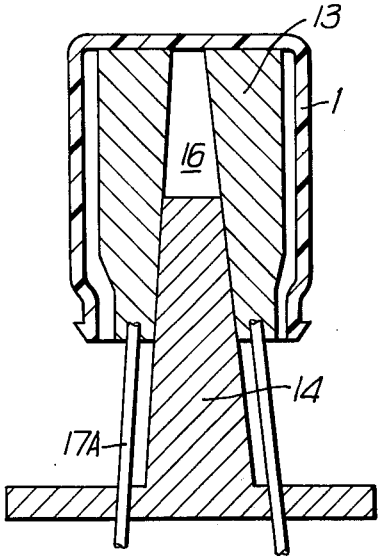

FIGS. 11 and 12 show a modification to the mould shown in FIGS. 8, 9 and 10. The modification consists of providing inclined guide bars 17*a* so that withdrawal of second segment 14 causes a closing together of guide bars 17*a* which in turn causes a simultaneous movement of first segments 13 into space 16. The modification has the advantage of obviating the use of push rods 18.

Figure 13:
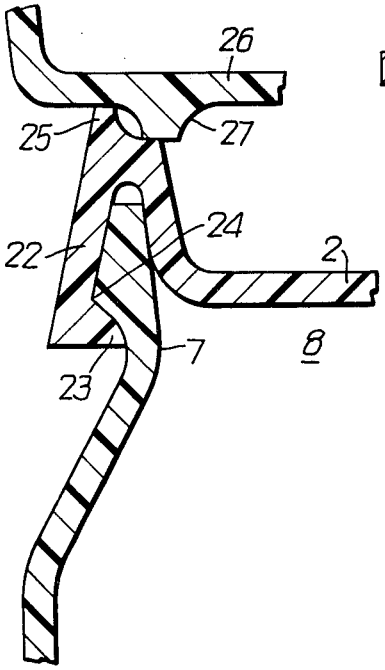
FIG. 13 shows in detail on a larger scale and in section part of a modified container and lid on which a second container is stacked.

FIG. 13 shows circular lid 2 fitted to perimeter 7 of open mouth 8. Lid 2 has a dependent skirt 22 provided with a lip 23 which makes a snap-action fit over a co-operating barbed profile 24 of extensions 5 and 6. Lid 2 is modified by the provision of an upstanding circumferential flange 25 and base 26 of the container is modified by the provision of dependent studs 27. Flange 25 and studs 27 co-operate to locate stacked lidded containers one on top of another.

Figure 14:
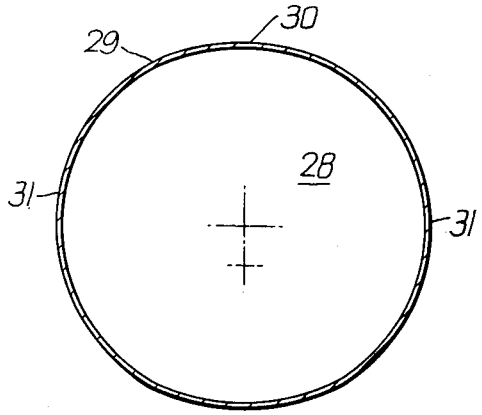
FIG. 14 shows in section a further modification of the container of FIG. 1.

FIG. 14 shows a modified container 28 which is a modification of container 1. Like container 1, modified container 28 has lobes 31 which are arcs of a common circle. The modification consists in replacing flat inset portions 4 of container 1 by curved inset portions 29. The maximum diameter of the modified container 28 through mid-points 31 of inset portions 29 is 96% of the diameter of common circle on which lobes 31 lie. The inset portions 29 subtend to angle of 60° to the principal axis with the result that in transverse section container 28 has the shape of an oblate circle. The curvature of inset portions 29 is merged into the curvature of lobes 31 and this disguises the presence of inset portions 29 and gives the modified container 28 a cylindrical appearance.

Figure 15:
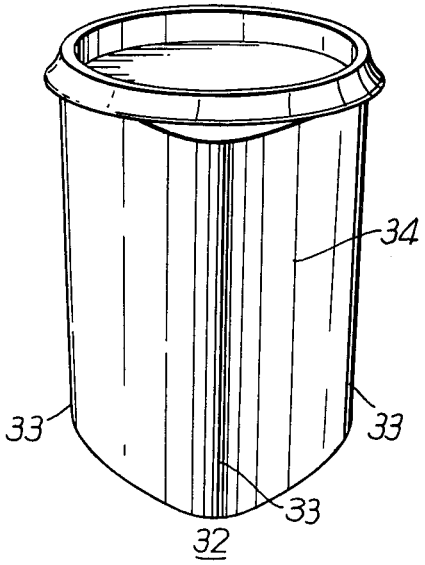
FIG. 15 shows in perspective a lidded tri-lobate container.
Figure 16:
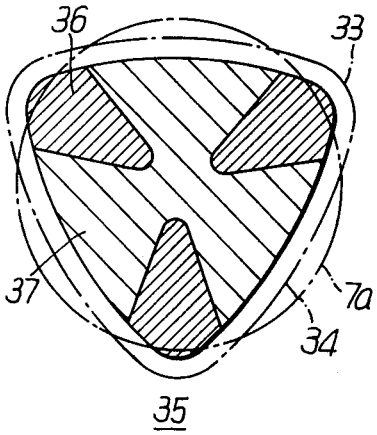
FIG. 16 shows in section a core for shaping the tri-lobate container of FIG. 15.

FIG. 15 shows a lidded tri-lobate container 32 having three lobes 33 and three curved inset portions 34. FIG. 16 shows a core 35 suitable for using in shaping container 32. Core 35 consists of three first segments 36 separated by a three-armed second segment 37.

Figure 17:
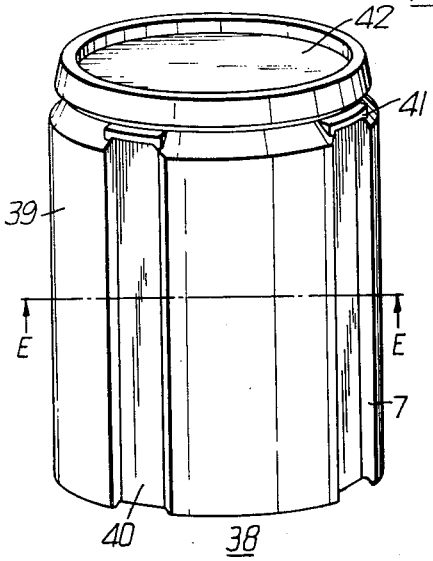
FIG. 17 shows in perspective a lidded fluted container.
Figure 18:
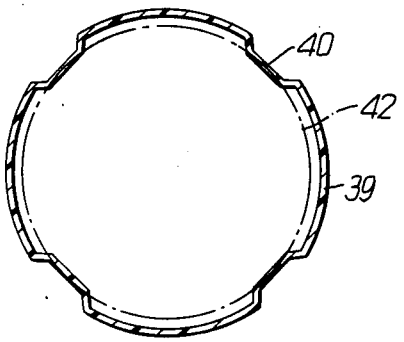
FIG. 18 shows a section on the line EE of FIG. 17.

FIGS. 17 and 18 show a lidded container 38 having four lobes 39 and inset portions which are longitudinal flutes 40. Ledges 41 are provided over flutes 40 so as to provide a fulcrum for use when levering snap-fitting lid 42 off container 38.

Figure 19:
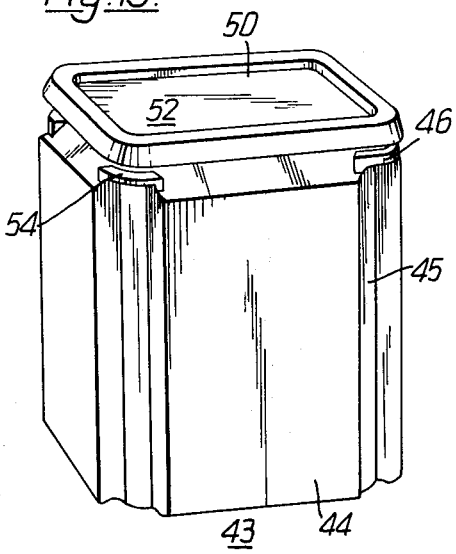
FIG. 19 shows in perspective a lidded rectangular container.
Figure 20:
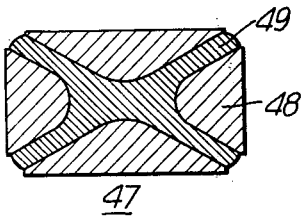
FIG. 20 shows in section a core for shaping the container of FIG. 19.

FIGS. 18 and 19 show a rectangular lidded container 43 having flat protruding portions 44 and fluted inset portions 45 surmounted by ledges 46 each of which provides a fulcrum for use when levering snap-fitting lid 50 off container 43. FIG. 20 shows a core 47 suitable for use in shaping container 43. Core 47 consists of four first segments 48 separated by second segment 49.

I claim:

1. An open-mouth container comprising:

(a) a body composed of at least two longitudinal protruding portions and at least two longitudinal inset portions, said protruding and inset portions having inner surfaces which define the inner surface of the body, and (b) extensions of the protruding and inset portions of the body which extensions define the perimeter of the mouth of the container, (c) wherein the inner surface of each protruding portion lies outside the perimeter of the mouth and the inner surface of each inset portion lies within the perimeter of the mouth so that the mouth-defining extension of each protruding portion extends inwardly of the inner surface of the body and the mouth-defining extension of each inset portion does not extend inwardly of the inner surface of the body and (d) wherein the dimensions of the inner surfaces of the protruding and inset portions are such that, if the inset portions were notionally removed from the body and the protruding portions were notionally moved inwards until they touched along their longitudinal boundaries, the notional inner surface defined by the inner surfaces of the touching protruding portions would then be capable of being passed through the mouth of the container.

2. A container according to claim 1 wherein the protruding and inset portions of the body are curved in transverse section, the protruding portions being of greater curvature than the inset portions.

3. A container according to claim 2 wherein the body of the container is bi-lobate.

4. A container according to claim 3 wherein the body of the container in transverse section has the shape of an oblate circle.

5. A container according to claim 4 wherein the maximum diameter of the inset portions of the body is at least 90% of the maximum diameter of the oblate circle.

6. A container according to claim 5 wherein the inset portions subtend an angle of from 20° to 80° to the principal axis of the container.

7. A container according to claim 1 wherein the inset portions of the body are re-entrant flutes.

8. A container according to claim 7 wherein each flute provides less than 10% of the internal transverse perimeter of the container.

* * * * *